United States Patent [19]

Iiyama et al.

[11] 4,026,280

[45] May 31, 1977

[54] CHOKE CONTROL SYSTEM FOR INTERNAL COMBUSTION ENGINE

[75] Inventors: Masahiko Iiyama; Takashi Kamezaki, both of Tokyo, Japan

[73] Assignee: Honda Giken Kogyo Kabushiki Kaisha, Tokyo, Japan

[22] Filed: Aug. 14, 1975

[21] Appl. No.: 604,886

[30] Foreign Application Priority Data

Aug. 15, 1974 Japan ..... 49-92809

[52] U.S. Cl. ..... 123/119 F; 123/75 B; 123/127; 123/DIG. 4; 261/23 A; 261/39 B

[51] Int. Cl.[2] ..... F02M 25/06

[58] Field of Search ..... 123/119 F, 32 SP, 32 ST, 123/32 SA, 127, 75 B, DIG. 4; 261/23 A, 39 B

[56] References Cited

UNITED STATES PATENTS

| | | | |
|---|---|---|---|
| 3,659,564 | 5/1972 | Suzuki et al. | 261/23 A |
| 3,785,624 | 1/1974 | Marsel | 261/23 A |
| 3,817,223 | 6/1974 | Doss | 123/32 SP |
| 3,830,206 | 8/1974 | Asaka et al. | 261/23 A |
| 3,837,322 | 9/1974 | Shishido | 123/75 B |
| 3,842,810 | 10/1974 | Yagi et al. | 123/127 X |
| 3,967,600 | 7/1976 | Iiyama | 123/119 F X |

*Primary Examiner*—C. J. Husar
*Assistant Examiner*—Ira S. Lazarus
*Attorney, Agent, or Firm*—Lyon & Lyon

[57] ABSTRACT

A first choke valve is mounted in a main intake passage carrying a lean mixture to a main combustion chamber, and a second choke valve is mounted in an auxiliary intake passage carrying a rich mixture to a relatively small auxiliary chamber. Spark ignition of the mixture in the auxiliary combustion chamber projects a flame through a torch nozzle connecting the chambers to ignite the lean mixture in the main combustion chamber. Control of the main choke valve for moderately cold starting or extremely cold starting is accomplished automatically by means of a control element driven by a heat responsive bimetal element, or by means of a manually operated control element. In either case, overtravel of the control element after the main choke valve closes stores energy in a spring to increase closing torque of the main choke valve, and also moves the auxiliary choke valve toward closed position, to improve engine startability under extremely cold conditions. Both choke valves open in response to complete firing of the engine.

9 Claims, 4 Drawing Figures

CHOKE CONTROL SYSTEM FOR INTERNAL COMBUSTION ENGINE

This invention relates to internal combustion spark ignition engines having a main combustion chamber which receives a lean mixture from a first carburetor, a smaller auxiliary combustion chamber which receives a rich mixture from a second carburetor, and spark ignition means for igniting the mixture in the auxiliary combustion chamber to project a flame through a torch nozzle to ignite the mixture in the main combustion chamber. An engine of this general type is disclosed in the Date and Yagi Pat. No. 3,890,942 granted June 24, 1975. The present invention relates to a choke system and controls therefor for both carburetors in order to provide good startability for engine ambient temperatures which are either moderately cold or extremely cold. Control of the first choke valve in the carburetor supplying the lean mixture is accomplished automatically using a heat responsive bimetal element or, alternately, by means of a manually operated control element. Control of the second choke valve for the second carburetor supplying the rich mixture is accomplished by mechanism coordinated with the operation of the first choke valve, and constructed so that the second choke valve is closed only when the ambient temperature of the engine is extremely cold. Overtravel of the choke system actuator after the main choke valve closes has two effects: (1) It stores energy in a spring to increase the closing torque of the first choke valve, and (2) it moves the second choke valve toward closed position.

Low temperature startability of internal combustion engines of the general type disclosed in said U.S. Pat. No. 3,890,942 has been achieved to a certain extent by employing a choke valve on the main carburetor that produces the lean mixture. The enriched lean mixture then supplied by the main carburetor to the main combustion chambers has the effect of also enriching the mixture in the auxiliary combustion chamber at the instant of ignition, because of the movement of enriched lean mixture from the main combustion chamber through the torch nozzle and into the auxiliary combustion chamber during the compression stroke. However, if the engine ambient temperature is lower than about −20° C, atomization of the fuel becomes extremely difficult and loss of fuel in the air-fuel mixture occurs because of adherence of liquid fuel droplets to the inner walls of the intake passages and combustion chamber walls. Thus, the true air-fuel ratio of the mixture in the combustion chambers is so lean as to make it difficult to start the engine under extremely cold conditions.

The first object of this invention, therefore, is to provide a control system for the two choke valves of the two carburetors, which control system is capable of improving the startability of the engine when the engine is cold or extremely cold. The second object of this invention is to provide such a control system which is capable of diluting the air-fuel ratios of the mixtures supplied to the main combustion chamber and the auxiliary combustion chamber automatically when the engine reaches the complete firing condition, and thereby reduce the amount of unburned components of fuel in the exhaust gas.

Other and more detailed objects and advantages will appear hereinafter.

Figure 1:
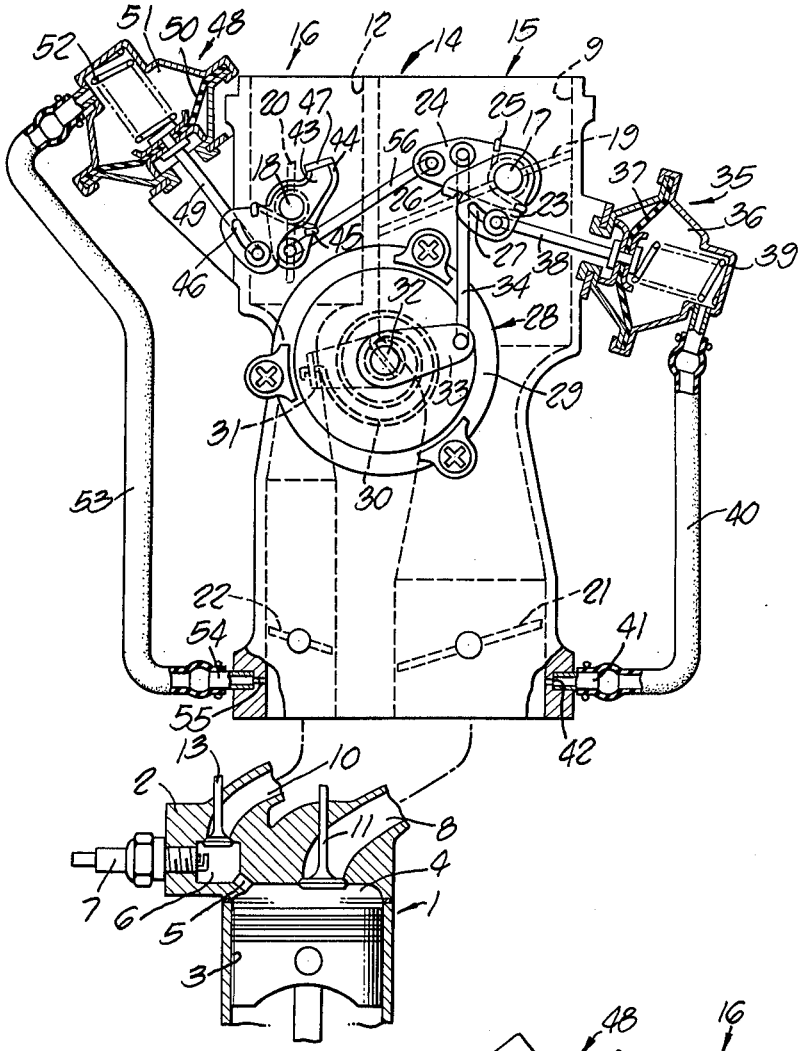
FIG. 1 is a side elevation partly in section showing a preferred embodiment of this invention.
Figure 2:
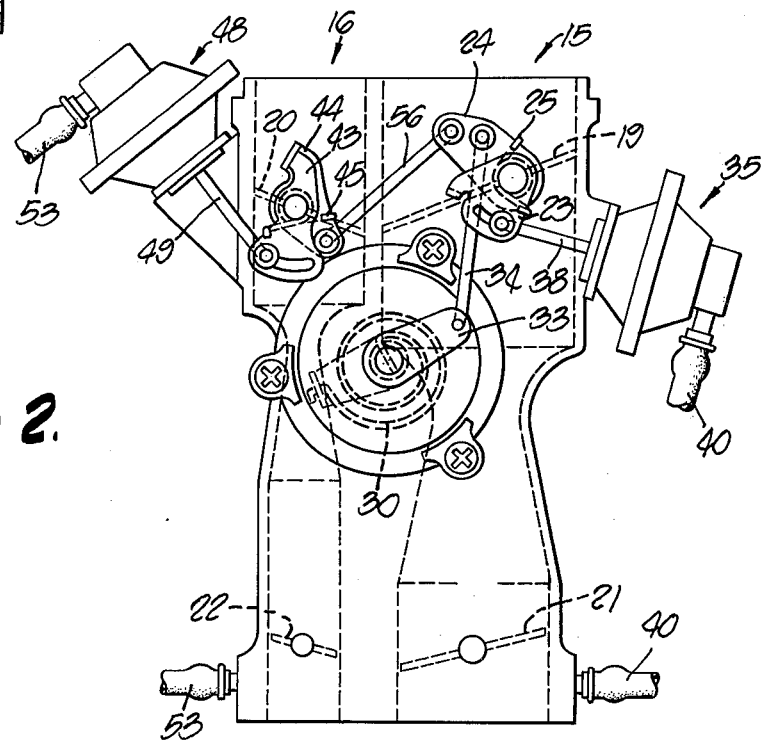
FIG. 2 is a side elevation of a portion of the device shown in FIG. 1, certain of the parts being illustrated in a different position.

Referring to the drawings, and particularly to FIGS. 1 and 2, the engine 1 is provided with a head 2 and a cylinder 3 forming a main combustion chamber 4. An auxiliary combustion chamber 6 is formed in the head 2 and connected through a torch opening 5 to the main combustion chamber 4. A spark plug 7 has electrodes positioned to ignite an air-fuel mixture in the auxiliary combustion chamber 6. A main intake passage 8 communicates with the main combustion chamber 4, controlled by the main intake valve 11. An auxiliary intake passage 10 communicates with the auxiliary combustion chamber 6, controlled by the auxiliary intake valve 13. The valves 11 and 13, as well as an exhaust valve (not shown) for the main combustion chamber 4, are all operated by conventional valve controlling mechanism (not shown).

A carburetor assembly 14 is connected to the upstream end of the intake passages 8 and 10. This carburetor assembly 14 comprises a lean mixture producing carburetor 15 having a main intake bore 9 connected to the main intake passage 8. A rich mixture producing carburetor 16 has an auxiliary intake bore 12 connected to the auxiliary intake passage 10. The main choke valve 19 is pivotally supported in the main intake bore 9 in an off-center position by means of the choke valve shaft 17 to which it is fixed. Similarly, an auxiliary choke valve 20 is pivotally supported in the auxiliary intake bore 12 in an off-center position by means of the choke valve shaft 18 to which it is fixed. Because of the off-center mounting of the choke valves 19 and 20, the intake vacuum of the engine applies a counterclockwise opening torque to the main choke valve 19 and applies a clockwise opening torque to the auxiliary choke valve 20. The main throttle valve 21 is positioned in the main intake bore 9 downstream from the main choke valve 19, and the auxiliary throttle valve 22 is positioned in the auxiliary intake bore 12 downstream from the auxiliary choke valve 20.

A first main choke lever 23 is fixed to the valve shaft 17 of the main choke valve 19 at its projecting end. The second main choke lever 24 is mounted to turn on said projecting end of the valve shaft 17 so as to permit it to turn freely. The two levers 23 and 24 are coupled to each other by means of a coupling spring 25 of the torsion coil type. The first main choke lever 23 is provided with a stopper 26 that is held in contact with a side of the second main choke lever 24 by the torsional force of the coupling spring 25. An arcuate slot 27 in the first main choke lever 23 is concentric with the axis of the choke valve shaft 17.

A choke valve operating device generally designated 28 employs a heat responsive bimetal element 30 for actuation of the second main choke lever 24. The device 28 includes a control box 29 mounted in front of the carburetor assembly 14 and containing the bimetal element 30 of spiral shape. The control box 29 also contains an electric heater (not shown) to heat the bimetal element 30 when the engine is in motion. The outer end of the bimetal element 30 is hooked on a retainer 31 fixed to the control box 29, and the inner end thereof is attached to a rotary shaft 32 mounted at the center of the control box 29. A driving lever 33 is fixed to the outside end of the rotary shaft 32 and this driving lever 33 is connected to the second main choke lever 24 through the connecting rod 34. The temperature inside the control box 29 is controlled by the engine ambient temperature when the engine is not in motion and by the electric heater when the engine is in motion. As the temperature inside the control box 29 raises, the bimetal element 30 moves the driving lever 33 in a clockwise direction to open the main choke valve 19.

A main vacuum actuator 35 is provided at one side of the carburetor assembly 14. This main vacuum actuator 35 includes an operating rod 38 fixed to the center of an operating diaphragm 37 installed on one side of a vacuum chamber 36. The operating rod 38 has a projecting end engaging the arcuate slot 27 of the first main choke lever 23 in a manner so that it can slide freely. The vacuum chamber 36 houses a compressed return spring 39 that acts to project the operating rod 38. A vacuum signal pipe 40 is connected at one end to the vacuum chamber 36 and at the other end to a vacuum outlet pipe 41 downstream from the main throttle valve 21 and communicating with the main intake bore 9. The vacuum outlet pipe 41 is connected to the main intake bore 9 through an orifice 42.

A first auxiliary choke lever 43 is fixed to the valve shaft 18 of the auxiliary choke valve 20. The valve shaft 18 also supports a second auxiliary choke lever 44. This lever 44 is of the bell crank type and is mounted to turn freely with respect to the valve shaft 18. The two levers 43 and 44 are coupled to each other with a coupling spring 45 of torsion coil type. The second auxiliary choke lever 44 is connected at one end to the second main choke lever 24 through a connecting rod 56. The first auxiliary choke lever 44 is provided at one end with an arcuate slot 46 that is concentric with the axis of the valve shaft 18. The second auxiliary choke lever 44 is equipped with a stopper 47 and comes in contact by torsional force of the coupling spring 45 with the other end of the first auxiliary choke lever 43.

An auxiliary vacuum actuator 48 is mounted at one side of the carburetor assembly 14 and includes an operating rod 49 which is engaged with the arcuate slot 46 of the first auxiliary choke lever 43, in a manner so that it can slide freely. The operating rod 49 is fixed at the center of the operating diaphrgm 50 forming one side of the vacuum chamber 51 within the auxiliary vacuum actuator 48. The vacuum chamber 51 houses a compressed return spring 52 that acts to project the operating rod 49. A vacuum signal pipe 53 is connected at one end to the vacuum chamber 51 and at the other end to a vacuum outlet pipe 54 installed downstream from the auxiliary throttle valve 22 and communicating with the auxiliary intake bore 12. The vacuum outlet pipe 54 is connected to the auxiliary intake bore 12 through an orifice 55.

In the operation of this embodiment of the invention, the intake stroke of the engine draws a lean mixture from the main carburetor 15 through the main intake passage 8 into the main combustion chamber 4. At the same time a rich mixture produced by the auxiliary carburetor 16 is drawn into the auxiliary combustion chamber 6 through the auxiliary intake passage 10. During the following compression stroke of the engine, the rich mixture is diluted moderately by a lean mixture entering the auxiliary combustion chamber through the torch nozzle 5, and at the end of the compression stroke the mixture in the auxiliary combustion chamber is readily ignitable by a spark. When the spark plug ignites the air-fuel mixture in the auxiliary combustion chamber 6, a flame is injected vigorously through the torch nozzle 5 into the main combustion chamber 4 to burn the lean mixute therein. The overall air-fuel ratio is very lean.

When the engine is not in motion, the respective vacuum chambers 36 and 51 of the vacuum actuators 35 and 48 return to atmospheric pressure, and their operating rods 38 and 49 are held in projected position by force of the return springs 39 and 52, respectively, with their projecting ends stopping midway in the arcuate slots 27 and 46. Accordingly, turning movement of the main and auxiliary choke levers 23 and 43 are not restrained.

When the bimetal element 30 in the control box 29 senses the engine ambient temperature and deforms in accordance with lowering of the temperature, the driving lever 33 is turned counterclockwise as viewed in FIG. 1. This action causes the connecting rod 34 to turn the choke levers 23 and 24 in a clockwise direction to close the main choke valve 19. As the engine ambient temperature lowers further, deformation of the bimetal element 30 continues, but the first main choke lever 23 fixed to the main choke valve 19 cannot move beyond the closed position shown in FIG. 1. The second main choke lever 24 alone keeps turning, as permitted by the coupling spring 25. The increased torsional force of the coupling spring 25 acts through the first main choke lever 23 as closing torque applied to the main choke valve 19.

During the shifting of the main choke valve 19 from its fully open position to its closed position, the rotating path of the second main choke lever 24 does not produce significant variation in the position of the auxiliary choke valve 20, which is held at approximately fully open position. However, because of excess turning movement of the second main choke lever 24 after closing of the main choke valve 19, the second auxiliary choke lever 44 pulls the connecting rod 56 to cause the auxiliary choke levers 43 and 44 to close the auxiliary choke valve 20, which finally closes fully as shown in FIG. 2.

Briefly stated, when the engine ambient temperature is moderately cold, the main choke valve 19 is nearly closed, so that the lean mixture produced by the main carburetor 15 becomes richer when the engine is started. When the engine ambient temperature is extremely cold, closing torque of the main choke valve 19 increases and the opening of the auxiliary choke valve 20 decreases, so that when the engine is started the lean mixture from the main carburetor 15 becomes richer and also the rich mixture produced by the auxiliary carburetor 16 becomes richer at the same time. Accordingly, the engine starts immediately whether the ambient temperature is moderately cold or extremely cold.

After starting of the engine and about the time when revolutions of the engine stabilize to some extent so that the engine is in the state of so-called complete firing, the intake vacuum of the engine is reflected through the orifices 42 and 55 and the vacuum signal pipes 40 and 53, respectively, reducing the pressure in the main vacuum actuator 35 and the auxiliary vacuum actuator 48. The operating diaphragms 37 and 50 move rearward to compress the springs 39 and 52, respectively, causing the operating rods 38 and 49 to retract. As a result, the projecting end of the operating rod 38 engages the right end of the arcuate slot 27 to rotate the first main choke lever 23 counterclockwise, and when force of the operating diaphragm 37 is brought into equilibrium with the torsional force of the coupling spring 25, the diaphragm 37 ceases to move rearward, and therefore the main choke valve 19 is opened to a choke pulldown angle corresponding to the engine ambient temperature.

As the operating rod 49 moves rearward, its projecting end engages the left end of the arcuate slot 46 to turn the first auxiliary lever 43 clockwise against the force of the coupling spring 45. The second auxiliary choke lever 44 remains at its position. The coupling spring 45 is made so that it yields to the force of the operating diaphragm 50. Thus, the rich mixture produced by the auxiliary carburetor 16 returns to its normal concentration, and although the entire engine may not yet be heated, the auxiliary combustion chamber 6 of small volume is heated comparatively rapidly, so that it can insure vaporization of mixture drawn into it to produce good electrical ignition.

Because of the fact that the main choke valve 19 is opened to a choke pulldown angle, the mixture produced by the main carburetor 15 has an air-fuel ratio suitable for warming up the engine, and furthermore, with the lapse of time, the control box 29 is heated internally by an electric heater (not shown) so that the bimetal element 30 deforms thermally to rotate the second main choke lever 24 counterclockwise. Consequently, the torsional force of the coupling spring 25 reduces and the operating diaphragm 37 moves rearward to keep equilibrium therewith, causing the first main choke lever 23 to rotate so as to open the main choke valve 19 further. Then, when the operating diaphragm 37 has reached the backing limit, the second main choke lever 24 has come in contact with the stopper 26 to form a unitary assembly with the first main choke lever 23, and the main choke valve 19 keeps opening further in a gradual fashion, depending only upon the thermal deformation of the bimetal element 30. Thus, the concentration of the mixture drawn through the main intake bore 9 is leaned, thereby insuring optimum ignition by the torch flame in the main combustion chamber 4.

Figure 3:
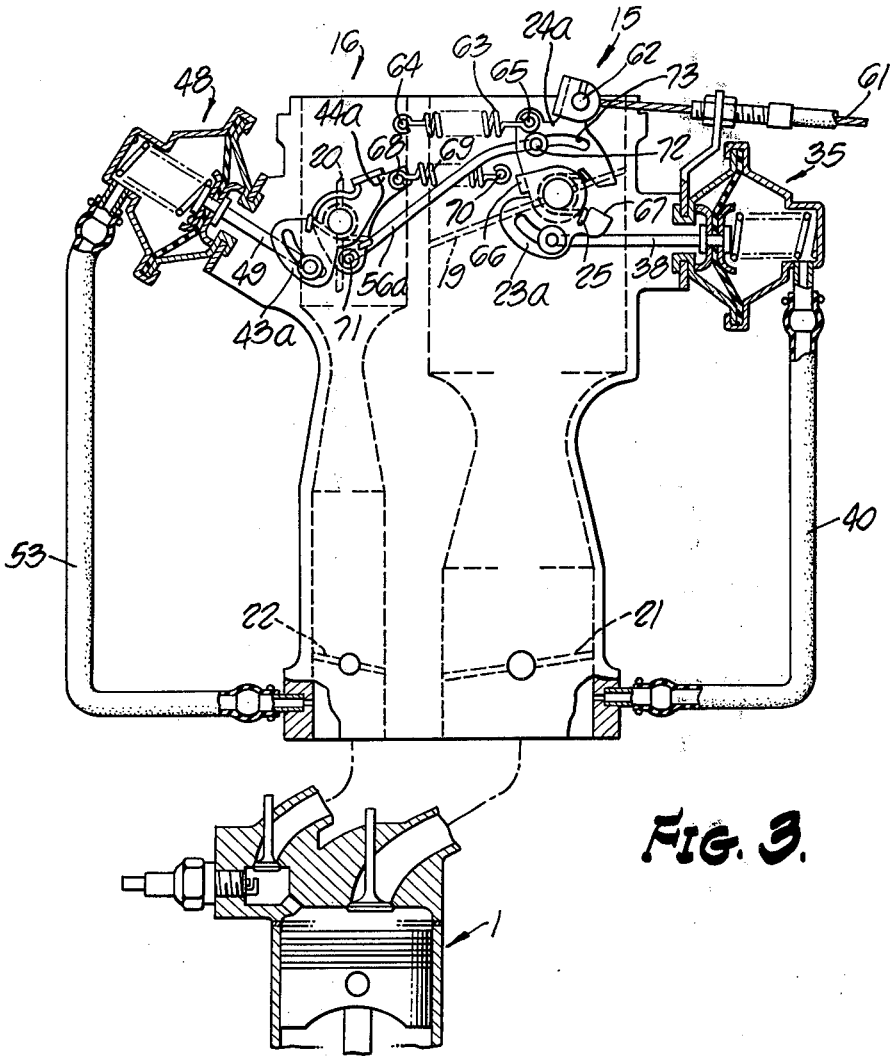
FIG. 3 is a side elevation partly in section showing a modification.
Figure 4:
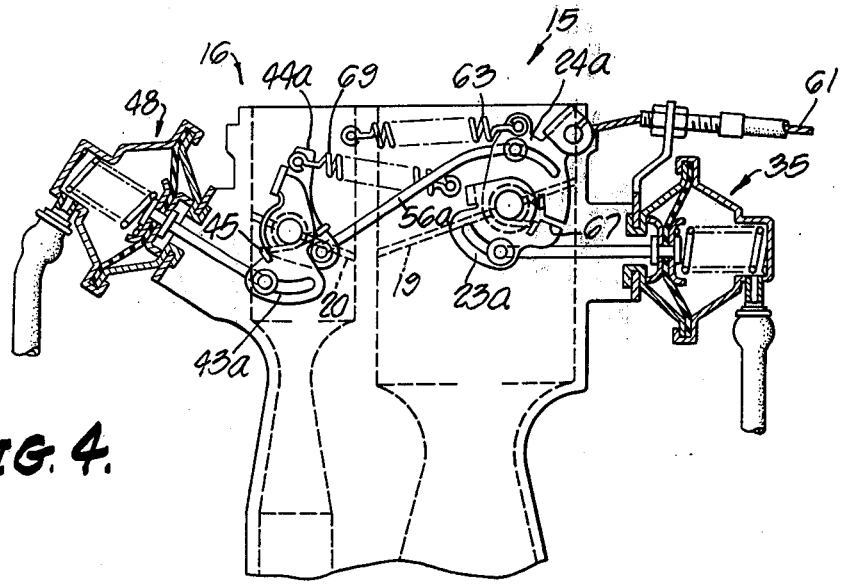
FIG. 4 is a side elevation partly in section showing a portion of the device of FIG. 3, certain of the parts being illustrated in a different position.

In the modified form of the invention shown in FIGS. 3 and 4, the control box 29 and the bimetal element 30 and associated parts are omitted, and in their place there is provided a manually operable choke wire 61 having a terminal fitting 62 pivotally received on the second main choke lever **24*a*. A tension spring 63 is fixed at one end 64 and is pivotally connected at the other end 65 to the second main choke lever 24*a*. The first main choke lever 23*a* is provided with a first stopper 66 and a second stopper 67 that come in contact alternately with either side of the second main choke lever 24*a*. In a similar fashion, the second auxiliary choke lever 44*a* is pivotally connected at 68 to one end of a tension spring 69 and the other end 70 is fixed in stationary position. The connecting rod 56*a* is pivotally connected to the second auxiliary choke lever 44*a* at 71, and the other end 72 of the connecting rod is free to slide in the arcuate slot 73.**

In other respects, the apparatus shown in the modification of FIGS. 3 and 4 is essentially the same as that previously described.

The coupling spring 25 acts to hold the first stopper 66 in contact with the side of the second main choke lever **24*a* so as to couple the two levers 23*a* and 24*a* to each other. Therefore, if the vehicle driver pulls or releases the operating wire 61, both levers 23*a* and 24*a* move simultaneously to open and close the main choke valve 19, while the connecting rod 56*a* remains motionless by virtue of the lost motion permitted by the arcuate slot 73; the auxiliary choke valve 20** remains in its fully open position.

When the main choke valve 19 is closed, as shown in FIG. 3, further movement of the operating wire 61 to the right deforms the coupling spring 25 so that closing torque of the main choke valve 19 increases. This action is similar to the case described above in connection with the first embodiment of the invention, where the engine ambient temperature is extremely cold. Also, in the embodiment of FIGS. 3 and 4, the right end of the connecting rod 56 comes in contact with the left end of the arcuate slot 73 so that excess turning movement of the second main choke lever **24*a* causes the connecting rod 56*a* to move toward the right to rotate the second auxiliary choke lever 44*a* in a counterclockwise direction. Thus, as in the case of the first embodiment shown in FIGS. 1 and 2, the auxiliary choke valve 20 is moved toward the fully closed position as shown in FIG. 4. Therefore, as the movement of the operating wire 61 to the right increases in extent, the mixture produced by the main carburetor 15 first becomes gradually richer and then the mixture produced by the auxiliary carburetor 16** also becomes gradually richer.

When the engine is started and the main vacuum actuator 35 retracts its operating rod 38, the first main choke lever **23*a* is turned until the second stopper 67 comes in contact with one side of the second main choke lever 24*a*. In this way the main choke valve 19 is opened to a choke pulldown angle corresponding to the extent of movement of the operating wire 61. Also, when the second vacuum actuator 48 retracts its operating rod 49, the auxiliary choke valve 20** returns immediately to the fully opened position.

Later, when the driver releases the operating wire 61 in accordance with the rise of the engine temperature, the operating wire 61 moves to the left and the second main choke lever **24*a* turns in a counterclockwise direction under the force of the valve opening spring 63, and after having contacted the first stopper 66, it turns as a unit with the first main choke lever 23*a*, causing the main choke valve 19** to open.

In accordance with the invention as described above, a main and an auxiliary choke valve are provided on a main and an auxiliary carburetor, respectively, and when both choke valves are open, actuation of the choke system first causes the main choke valve to reduce its extent of opening, and after it has closed, the auxiliary choke valve reduces its opening while the closing torque of the main choke valve is increasing. Therefore, the mixtures produced by the main and auxiliary carburetors are made wider in the range of enrichment and adjustment of the overall air-fuel ratio, so that, within a wide range of temperatures extending from cold to extremely cold, mixtures of the desired richness can be produced readily at all times, thereby improving the startability of the engine.

Furthermore, when the engine is in a state of complete firing, the main choke valve is made to open to a specified choke pulldown angle, and the auxiliary choke valve remains fully open, so that misfire due to excessively rich mixture in the auxiliary combustion chamber is prevented from occurring, and ignition of the mixture in the main combustion chamber by the torch flame is insured. Therefore, warming up of the engine is stable and the overall air-fuel ratio of the mixture may be relatively lean even during the warmup period, so that unburned components of the fuel and other harmful emissions in the exhaust gas can be reduced.

Having fully described our invention, it is to be understood that we are not to be limited to the details herein set forth, but that our invention is of the full scope of the appended claims.

We claim:

1. In a choke control system for starting an internal combustion spark ignition engine having an auxiliary combustion chamber in communication with each main combustion chamber and having spark ignition means for igniting a mixture in the auxiliary combustion chamber, the improvement comprising, in combination: a main carburetor for supplying a lean mixture to the main combustion chambers, an auxiliary carburetor for supplying a rich mixture to the auxiliary combustion chambers, a main choke valve in the intake passage of the main carburetor, an auxiliary choke valve in the intake passage of the auxiliary carburetor, a control element connected to actuate the main choke valve through a spring so that overtravel of said control element after the main choke valve is closed stores energy in the spring, means connected to said control element to move the auxiliary choke valve toward closed position only after such overtravel has closed the main choke valve.

2. The combination set forth in claim 1 in which said control element is automatically actuated by means of a heat-responsive bimetal element.

3. The combination set forth in claim 1 in which said control element is actuated by a manually operable element, and resilient means acting to move each choke valve toward open position.

4. The combination set forth in claim 1 in which means responsive to engine intake vacuum are connected to open both of said choke valves upon complete firing of the engine.

5. The combination set forth in claim 1 in which each choke valve has a first lever secured to turn therewith about its axis and a second lever mounted to turn with respect to the first lever about that axis, said spring coupling the first and second levers of said main choke valve for unitary action during its closing movement, a second coupling spring connecting the first and second levers of said auxiliary choke valve, and a connecting rod pivotally connecting said second levers.

6. In a choke control system for starting an internal combustion spark ignition engine having an auxiliary combustion chamber in communication with each main combustion chamber and having spark ignition means for igniting a mixture in the auxiliary combustion chamber, the improvement comprising, in combination: a main carburetor for supplying a lean mixture to the main combustion chambers, an auxiliary carburetor for supplying a rich mixture to the auxiliary combustion chambers, a main choke valve in the intake passage for the main carburetor, an auxiliary choke valve in the intake passage of the auxiliary carburetor, each choke valve having a first lever secured to turn therewith about its axis and having a second lever mounted to turn with respect to the first lever about that axis, a first coupling spring connecting the first and second levers of the main choke valve, a second coupling spring connecting the first and second levers of the auxiliary choke valve, a control element connected to actuate the second lever of the main check valve, and a connecting rod pivotally connecting said second levers.

7. The combination set forth in claim 6 in which said control element is automatically actuated by means of a heat-responsive bimetal element.

8. The combination set forth in claim 6 in which said control element is actuated by a manually operable element, and resilient means acting to move each choke valve toward open position.

9. The combination set forth in claim 6 in which means responsive to engine intake vacuum are connected to open both of said choke valves upon complete firing of the engine.

* * * * *